US005133103A

United States Patent [19]

Nagasawa

[11] Patent Number: 5,133,103

[45] Date of Patent: Jul. 28, 1992

[54] HAIRBRUSH

[75] Inventor: Yukuo Nagasawa, Tokyo, Japan

[73] Assignee: Somiel Products Co., Ltd., Tokyo, Japan

[21] Appl. No.: 601,891

[22] Filed: Oct. 23, 1990

[30] Foreign Application Priority Data

May 11, 1990 [JP] Japan ..... 2-48568

[51] Int. Cl.[5] ..... A46B 7/06; A46B 17/06

[52] U.S. Cl. ..... 15/184; 132/123

[58] Field of Search ..... 15/184, 185; 132/219, 132/119, 120, 123

[56] References Cited

U.S. PATENT DOCUMENTS 4,977,909 12/1990 Chou ..... 15/184 X 4,988,228 1/1991 Yeh ..... 15/184 X

FOREIGN PATENT DOCUMENTS 2132972 1/1973 Fed. Rep. of Germany ..... 15/184

*Primary Examiner*—Edward L. Roberts

*Attorney, Agent, or Firm*—Kane, Dalsimer, Sullivan, Kurucz, Levy, Eisele and Richard

[57] ABSTRACT

A hairbrush includes a shell having a bottom plate with perforations through which bristles may extend. A bristled plate is provided within the shell and arranged so that the bristles may extend through the perforations. A lever may be manipulated to restrain the bristled plate so that the bristles extend through the perforation or to retract the bristled plate so that the bristles are contained within the shell.

1 Claim, 5 Drawing Sheets

HAIRBRUSH

BACKGROUND OF THE INVENTION

1. Field of the Invention

The present invention relates to a hairbrush. More particularly, it relates to a hairbrush which permits its bristles to retract and protrude voluntarily in and out of a brush shell by a simple manipulation and provides a convenient portability, without impairing its structural stability and easy usability.

2. Description of the Prior Art

In the pas,, portable hairbrushes constructed in forms as shown in the appended FIGS. 8 and 9 have been known. The hairbrush shown in FIG. 8 comprises a brush shell (103) having a receptacle hollow, in which a bristled plate (100) provided thereon with combing bristles (104) is placed, and a plug piece (101) having a slant insertion top inserted in a hole (102) for use for pressing onto the bristled plate by turning the plug piece. The hairbrush shown in FIG. 9 provides for a mechanism for protrusion and retraction of a bristled plate (111) with a rotatable U-arm (113) rotated by turning a knob (112) fixed thereto, wherein the bristled plate is moved back and forth by the displacement of the eccentric arm (113) upon its rotation.

These prior arts have such disadvantages as follows:

In the case of the hairbrush shown in FIG. 8, the bristles are retracted only partly into the brush shell and the bristle tops remaining are obstructive, thus impairing its portability. In addition, the manner of manipulation of the plug piece is somewhat bothersome since one must turn the plug piece (101) against the friction force increased by the pressing force of the spring members employed and settle it when the bristled plate (100) has been lifted.

in the hairbrush shown in FIG. 9, a ratchet mechanism is employed for fixing the bristled plate (111) at the pressing point of the springs, so that a larger number of elements are necessary and the mechanism is somewhat complicated. In addition, a small knob (112) disposed on the side face of the brush body is turned for moving the bristled plate (111) back and forth via a relatively thin bent arm (113), requiring a delay in manipulation with more finer power.

SUMMARY OF THE INVENTION

The object of the present invention is to provide a hairbrush which permits the accomodation of the bristle part almost completely within a brush shell with easy manipulation for retracting and protruding the blistles in and out of the brush shell without impairing the mechanical strength thereof, allowing easy usability.

The above object is attained by a hairbrush according to the present invention in which a novel and simple mechanism for realizing retraction and protrusion of the bristles back and forth in and out of the brush shell using a double arm lever means for manipulation of the mechanism.

Thus, according to the present invention, a hairbrush comprising a brush shell for accomodating therein bristles for combing hair, comprising an upper housing and a bottom plate, said bottom plate being provided with a plurality of slits or perforations for permitting emergence and retraction of the bristles therethrough, a bristled member accomodated in said brush shell and provided on its one side with a number of bristles located so as to permit protrusion through said plurality of slits or perforations, said bristled member being securely but so movably arranged within said brush shell as to permit said bristles to protrude or retract through said plurality of slits or perforations by shifting said bristled member, a means for shifting said bristled member to effect said protrusion and retraction of the bristles through said slits or perforations, a means for fixing said means for shifting the bristled member so as to restrain it rigidly upon protrusion of the bristles from said slits or perforations and a manipulation member for actuating said bristled member shifting means to effect protrusion or retraction of the bristles through said slits or perforations being provided, characterized in that said means for shifting the bristled member comprises spring means compressedly arranged between the bottom plate and the bristled member for biasing the bristled member to be held retracted from the slits or perforations, a double arm lever means placed in a lever-receiving cut-out provided in the upper housing and pivoted on a journal pin disposed laterally to the longitudinal direction of the brush, with its one arm to be manipulated by the user's hand by turning it around the journal pin, having such an extension from the journal pin as is adequate for manipulating the lever and resting, in the retracted housing on the side opposite to the gripping end of the brush, and with its other arm having such an extension from said journal pin as is adapted to protrude the bristles, when manipulated, at a pertinent predetermined height from the shell bottom plate through the slits or perforations and resting, in the retracted state of the bristles, on the rear face of said bristled member being biased by the resilient force of said spring means, and a stopper member for attaining a rigid fixation of the double arm lever, and thus of the bristled member, upon manipulation by turning the lever around the journal pin, at a definite position of the lever under the cooperation of abutment of the lever arm on the stopper member and of biasing the resilient force of the spring means.

By the employment of the mechanism with double arm lever means as the manipulation piece according to the present invention, an easy finger operation of the bristled member, almost complete inclusion of the bristles within the brush shell and a rigid and firm settlement of the bristled member after protrusion of the bristles from the shell bottom plate are achieved since a longer lever arm for the manipulation can be availed of by incorporating such an arrangement that the double lever is placed in a cut-off provided in the upper housing and is pivoted on a journal pin disposed laterally to the longitudinal direction of the brush, with its one arm, which is served for manipulation by the user's hand by turning it around the journal pin, having such an extension from the journal pin as is adequate for manipulating the lever and resting, in the retracted state of the bristles, on the outer face of the shell's upper housing of the bristles, on the outer face of the shell's upper housing on the side opposite the gripping end of the brush and with its other arm having such an extension from said journal pin as is adapted to have the bristles protrude, when manipulated, at a pertinent predetermined height from the shell bottom plate through the slits or perforations and resting, in the retracted state of the bristles, on the rear face of said bristled member biased by a spring means.

DETAILED DESCRIPTION OF THE INVENTION

Now, the invention will be explained fully with reference to drawings attached.

Figure 6:
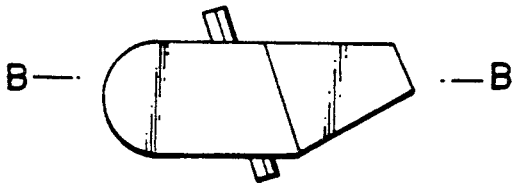
FIG. 6 is a plan view which shows the double arm lever means employed in the hairbrush of FIG. 1.
Figure 7:
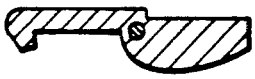
FIG. 7 is a vertical sectional view of the lever means of FIG. 6 along the line 7—7 of FIG. 6.
Figure 8:
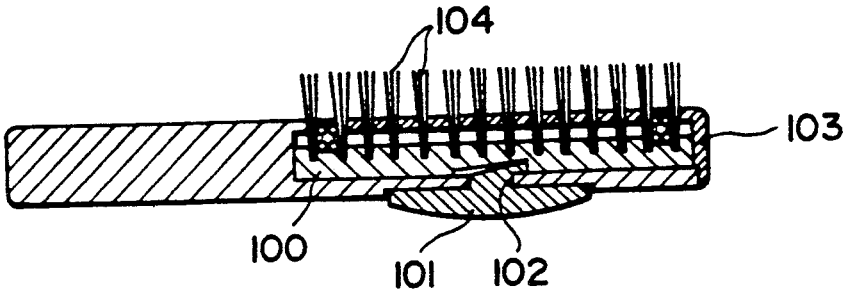
FIGS. 8 and 9 are perspective views which each show a conventional hairbrush.
Figure 9:
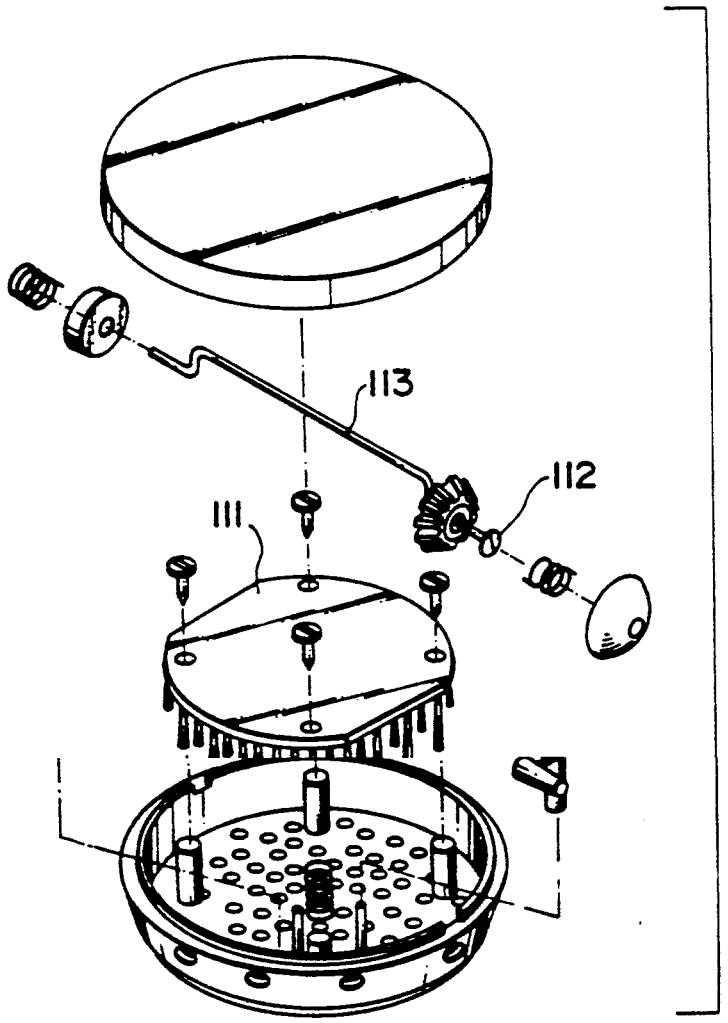

FIGS. 1 through 5 show the hairbrush of the invention. FIGS. 6 and 7 show the lever portion of the hairbrush.

Figure 1:
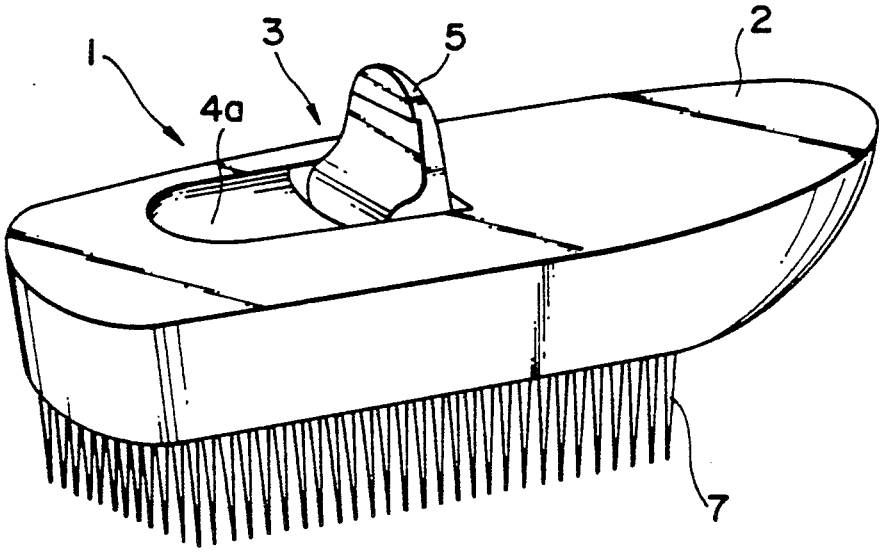
FIG. 1 is a perspective view which shows a typical embodiment of the hairbrush according to the present invention.

The hairbrush according to the present invention comprises a brush shell (1) in which a gripping end (2) and a bristle part (3) are put together into an integral unit, as shown in FIG. 1.

Figure 2:
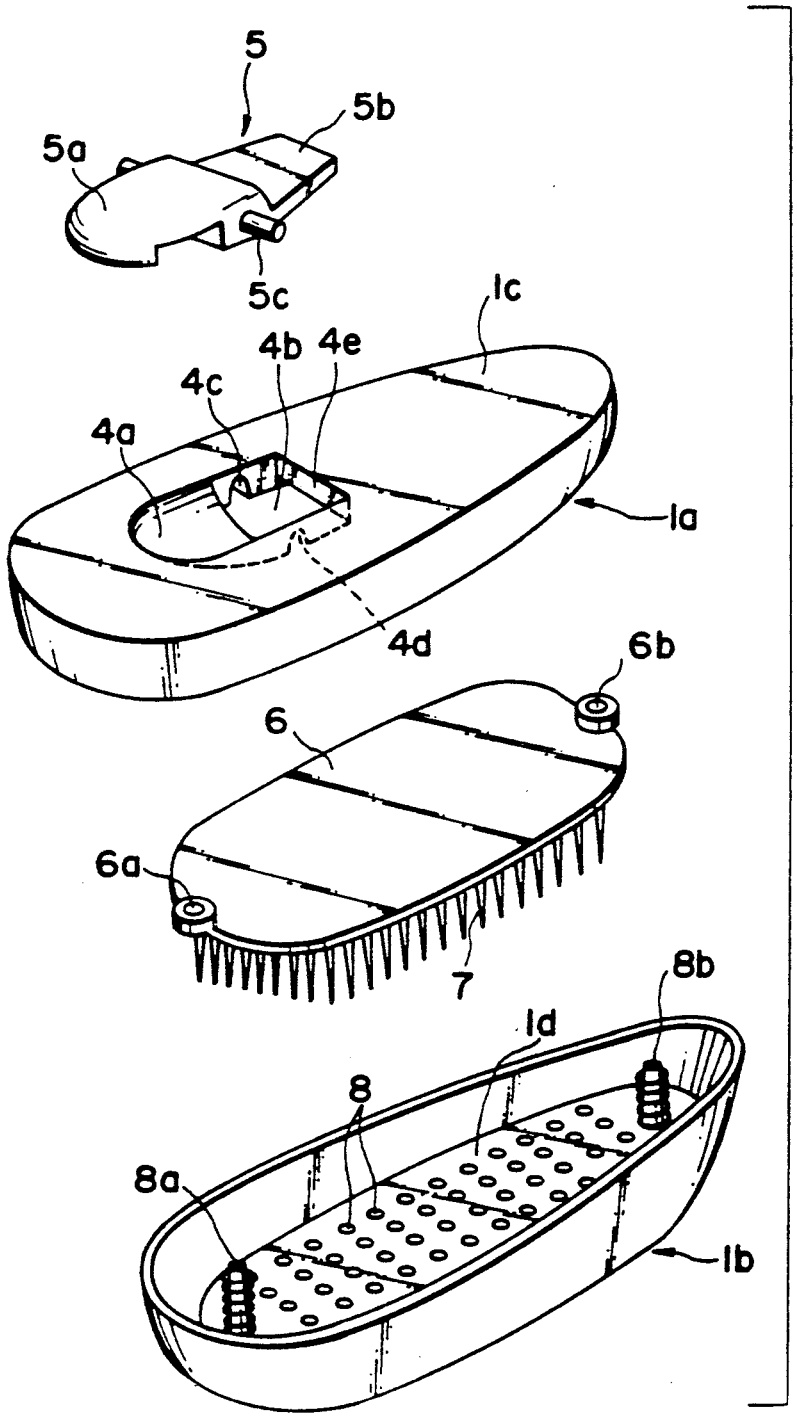
FIG. 2 is an explanatory resolutional schematic illustration of the hairbrush of FIG. 1 in a perspective view.

The hairbrush is composed, as shown in FIG. 2, of the brush shell (1) constituted from an upper housing (1*a*) having a top plate (1*c*) provided with a cut-off (4*b*) for receiving double arm lever means (5) and a bottom plate (1*b*) having a plurality of slits or perforations (8) distributed over the bottom face thereof so as to permit emergence and retraction of the bristles (7) therethrough, and of a bristled member (6) accomodated within the brush shell (1) and being provided with said bristles (7) on the one side thereof.

The double arm lever means (5) is placed, as mentioned above, in the cut-off (4*b*) of the bristle part (3) of the top plate.

The cut-off (4*b*) is formed with a concave recess on the outer face of the top plate (1*c*) for resting thereon the manipulation arm (5*c*) of the lever means (5). This structure will serve as an ornamental appearance for the hairbrush and for easier finger operation of the arm with simultaneous prevention of unintentional actuation of the double arm lever (5).

The double arm lever means (5) has a configuration as shown in FIGS. 2 and 6 and is placed in the cut-off (4*b*) pivotingly on a journal pin (5*c*) disposed laterally to the longitudinal direction of the brush, with its one arm (5*a*) to be manipulated by the user's finger by turning it around the journal pin (5*c*), having such an extension from the journal pin (5*c*) as is adequate for manipulating the lever means (5) and resting on the concave recess on the outer face of the top plate (1*a*) in the retracted state of the bristles and with its other arm (5*b*) having such an extension from the journal pin (5*c*) as is adapted to have the bristles (7) protrude, when manipulated, at a pertinent predetermined height from the brush shell bottom face through the slits or perforations (8) and resting on the rear side of the bristled member (6) under being pressed from underneath by spring means (9) under intermediation by the bristled member (6). The journal pin (5*c*) is supported by bearing holes (4*c*, 4*d*) formed on both side faces of the cut-off (4*c*) under insertion therein.

Figure 4:
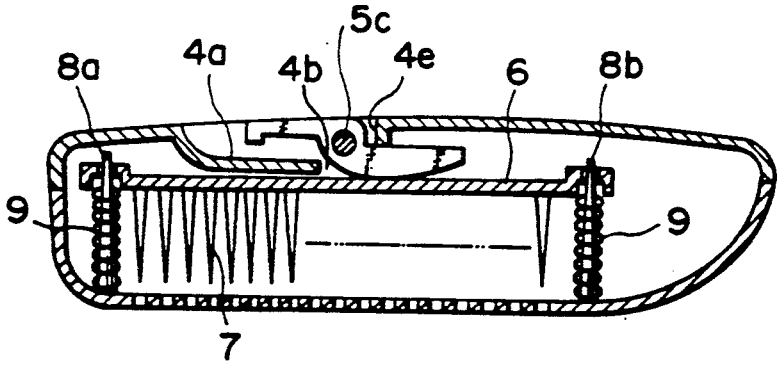
FIG. 4 is a vertical section of the hairbrush of Fig. 1 along the line 4—4 of FIG. 3.
Figure 5:
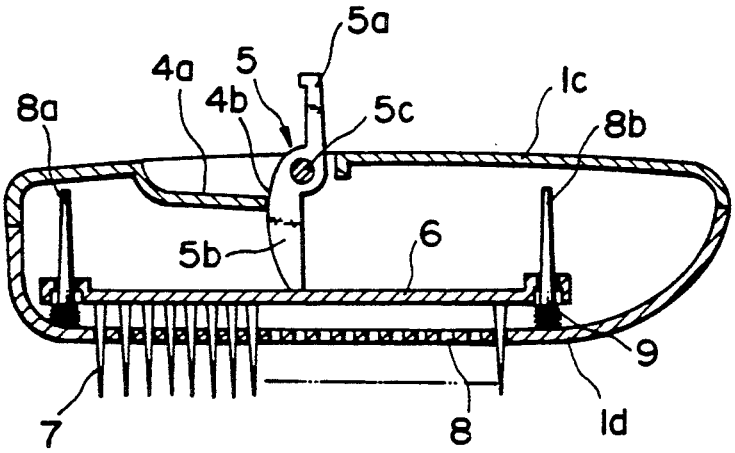
FIG. 5 is a vertical sectional view of the hairbrush of FIG. 1 along the line 4—4 of FIG. 3 in the state in which the bristles are protruded from the shell bottom plate.

When the lever means (5) is turned around the journal pin (5*c*), rotation of the lever arm will be limited by the edge of the cutout 4*a*, and the front end of the arm (5*b*) pushes the bristled member (6) down to the lower extreme position as shown in FIG. 5. (which depicts the lever just prior to abutting the sidewall). The rear face of the arm (5*b*) may preferably be convexed as shown in FIGS. 4, 5 and 7, so as to realize smooth sliding on the rear side of the bristled member (6) upon turning of the lever means (5), for the smooth movement of the bristles.

The bristled member (6) has a nearby elliptical shape including a flat plate, of which the front side, namely the side facing the bottom plate, is provided with a plurality of hair combing bristles (7) located so as to permit them to protrude from the bottom plate (1*b*) through the slits or perforations (8) on the bottom plate (1*b*).

The bottom plate (1*b*) is shaped in the form of a ship bilge so as to fit the upper housing (1*a*) tightly to build up the brush shell and has two guide posts (8*a*, 8*b*) inside thereof, which serve for guiding the bristled member (6) under insertion of each guide hole (6*a*, 6*b*) disposed at both ends of the bristled member (6) on each post. On each of the posts is also inserted a spring means (9) for the pressurized support of the bristled member (6). The spring means (9) may be two coil springs having the same length and are compressedly arranged on each of the guide posts (8*a*, 8*b*) in between the bristled member (6) and the bottom plate (1*b*) so as to create a stable support for the bristled member (6). The spring (9) will be more compressed when the bristled member (6) is shifted forward and the bristles (7) are protruded from the perforations (8) of the bottom plate (1*b*) by manipulating the double arm lever means (5), whereby a rigid settlement of the bristled member (6) upon use of the brush is facilitated When the double arm lever means is turned back, the resilient force of the spring means will cause the bristled member to be retracted into the brush shell firmly. Alternatives for such coil springs and for their arrangement may of course be possible.

Figure 3:
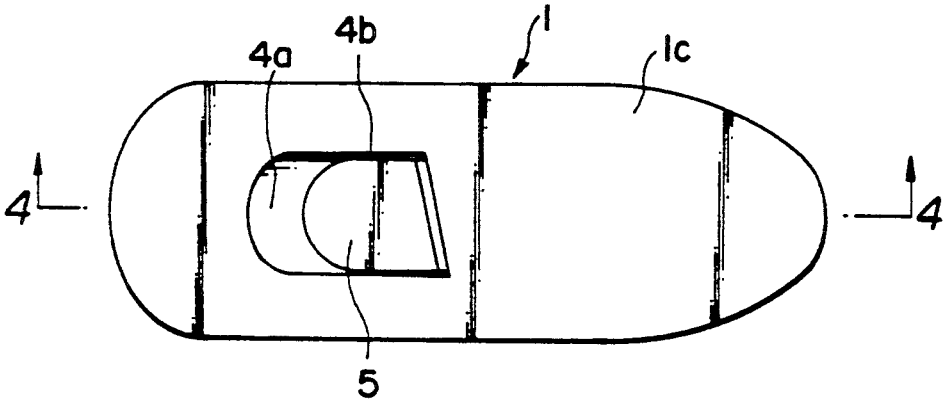
FIG. 3 is a plan view of the hairbrush of FIG. 1.

In the above embodiment, the settlement of the double arm lever means is quite firm due to the special arrangement of the lever means and the bristled member with the spring means, however, many other possible constructions may also be employed. For example:

the lever means can be arranged not only in the axial direction but also in various directions, such as an oblique arrangement, as shown in FIGS. 3 and 6. By this arrangement, a more comfortable manipulation of the lever means is realized, since this facilitates the seizure of the lever arm by the user's finger and prevents the eventual slippage of the lever arm, so that the handling stability becomes even better although the combing load is imparted.

The abutting arm (5*b*) can be shaped so as to have a nearly rectangular end portion of which the top edge extends not rectangularly to the longitudinal axis of the brush but nearly parallel to the journal pin (5*c*). By this arrangement, a surfacial contact of the top end of the arm (5*b*) with the bristled member (6) is realized, resulting in a more reliable arresting of the bristled member (6).

The manipulating end of the arm (5*a*) of the lever means (5) can have an L-shaped section, so as to facilitate manipulation by the finger.

The hairbrush according to the present invention offers many advantages from the construction described above.

The manipulation of the arm of the lever means can be achieved easily with less finger force, since the direction of manipulation by turning the arm of the lever means corresponds to the natural extension of the user's finger, and thus, even a one-hand operation may be possible.

The bristles are accomodated completely within the brush shell when not in use.

The manipulation arm is arranged in a close fitting to the brush shell and thus the ornamental effect is high.

The settlement of the bristled member is firm and rigid, resulting in a high stability when used.

I claim:

1. A hairbrush comprising:

a) a brush shell for accommodating therein bristles for combing hair, said shell having a gripping end and comprising an upper housing and a bottom plate, said bottom plate having a plurality of slits or perforations therein for permitting emergence and retraction of bristles therethrough, said shell upper housing including a lever receiving cutout including a recessed portion formed therein;

b) a bristled member disposed within said brush shell, said member having on its one side a number of bristles located so as to permit protrusion of said bristles through said plurality of slits or perforations, said bristled member being movably disposed within said brush shell to permit said bristles to protrude and retract through said plurality of slits or perforations by shifting said bristled member;

c) means for shifting said bristled member having positions wherein the bristles protrude through and retract from said slits or perforations, said shifting means including:

i) a spring means compressedly arranged between the bottom plate and the bristled member for biasing the bristled member to be held retracted from the slits or perforations, ii) a double arm lever means placed in said lever-receiving cutout provided in the upper housing and pivoted on a journal pin disposed laterally to a longitudinal direction of the brush, one arm being adapted to be amputated by the user'hand by rotating said lever about the journal pin, in the housing on the and with its other arm having an extension from said journal pin to urge the bristles through the shell bottom plate through the slits or perforations and resting, in the retracted state of the bristles, on the rear face of said bristled member and being biased by the resilient force of said spring means, and iii) limiting means for fixing the double arm lever, and thus the bristled member, by rotation of the lever about the journal;

d) said other arm interacting with said limiting means to restrain said shifting means, e) whereby said shell cutout receives a portion of said lever in said recessed portion and rigidly restrains the same when said bristles are in their retracted position and when said bristles are in their protruded position said one arm protrudes from said shell to facilitate griping of said hairbrush.

* * * * *